United States Patent [19]

Jaunin

[11] 4,228,648

[45] Oct. 21, 1980

[54] HOUR HAND CORRECTOR FOR DUAL DISPLAY TIMEPIECE

[75] Inventor: Jean-Pierre Jaunin, La Neuveville, Switzerland

[73] Assignee: Societe Suisse pour l'Industrie Horlogere Management Services S.A., Bienne, Switzerland

[21] Appl. No.: 950,354

[22] Filed: Oct. 11, 1978

[51] Int. Cl.[2] ..... G04C 3/00; G04B 27/00

[52] U.S. Cl. ..... 368/185; 368/76; 368/187

[58] Field of Search ..... 58/4 A, 23 R, 38, 39, 58/39.5, 50 R, 57.5, 58, 85.5

[56] References Cited

U.S. PATENT DOCUMENTS

| | | | |
|---|---|---|---|
| 3,823,545 | 7/1974 | Vittoz et al. | 58/23 R |
| 3,875,741 | 4/1975 | Hastings | 58/152 H |
| 3,911,665 | 10/1975 | Van Berkum | 58/50 R |
| 4,004,407 | 1/1977 | Fujita | 58/50 R X |
| 4,095,405 | 6/1978 | Tamaka | 58/58 |
| 4,170,870 | 10/1979 | Burdet | 58/23 R |

*Primary Examiner*—Edith S. Jackmon

*Attorney, Agent, or Firm*—Griffin, Branigan & Butler

[57] ABSTRACT

A dual display timepiece employs a stepping motor capable of rotation in one sense for driving hour and minute hands in an analogue display and an electronic digital display for displaying other information (second, date, chronograph, etc.). In order to facilitate hour hand corrections a logic circuit is provided which permits the user to enter the nature (positive or negative) and the amount of correction desired into the digital display. Following such entry the hour hand is corrected automatically by application of N×Y higher than normal frequency signals to the analogue display, where N corresponds to the number of signals required to effect a one hour or half hour correction and Y corresponds to the correction entered by the user.

12 Claims, 1 Drawing Figure

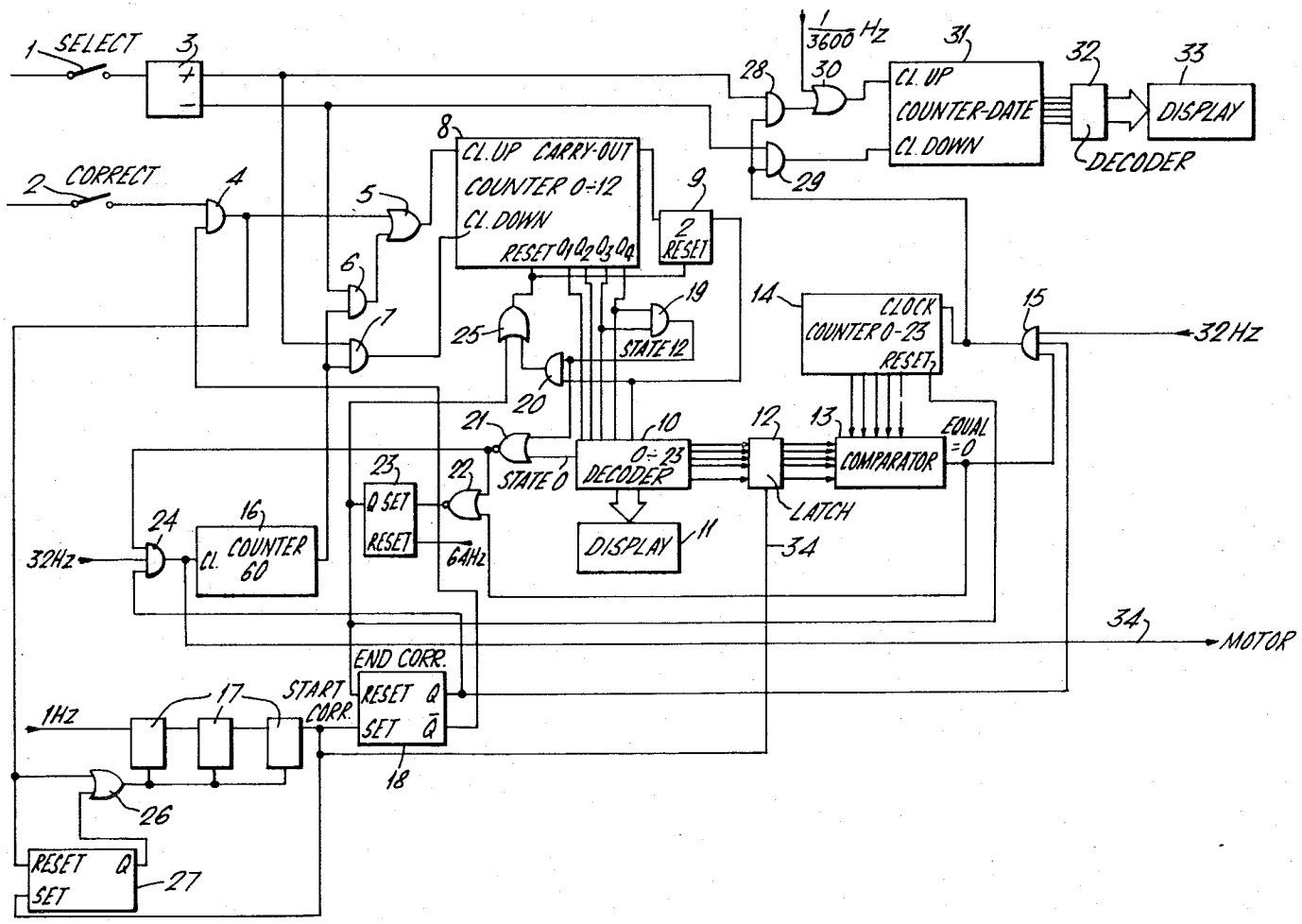
DISPLAY
DECODER
COUNTER-DATE
CL. UP
CL. DOWN
1/3600 Hz
32 Hz
MOTOR
CLOCK COUNTER 0-23
RESET
COMPARATOR
EQUAL =0
LATCH
0-23 DECODER
DISPLAY
2 RESET
STATE 12
CL. UP CARRY-OUT
COUNTER 0-12
CL. DOWN
RESET Q1 Q2 Q3 Q4
STATE 0
Q SET
RESET
64Hz
END CORR.
START CORR.
COUNTER 60
CL.
32Hz
1Hz
SELECT
CORRECT

HOUR HAND CORRECTOR FOR DUAL DISPLAY TIMEPIECE

BACKGROUND OF THE INVENTION

In the continuing development of timepieces those having a dual display are among the most recent to appear in the market place. Such timepieces generally provide an hour and minute hand for regular analogue display, said hands being driven by a stepping motor. The other portion of the display is digital in nature utilizing such well-known digital arrangements as are provided by liquid crystals and the like. The digital display may show for example date, seconds, and chronograph information should such be provided.

In most electronic timepieces certain complexities arise when the user wishes to apply corrections to the various displays thereof. While correction may be effected through strictly classical mechanical methods, where electro-mechanical analogue displays are concerned such arrangements are generally cumbersome, space consuming and rather expensive. For this reason recent developments have tended to proceed along entirely electronic lines.

The present invention is concerned with employing in a dual display timepiece the digital display in conjunction with user accessible switches in order to greatly facilitate hour hand corrections of the analogue display. Such corrections will be necessary whenever the user crosses a time zone or whenever for example there is a change-over from summer time to winter time and vice versa.

When the user wishes to correct the hour hand display he may enter the amount of the correction into the digital display along with a signal indicating whether this is to be added or subtracted. The invention provides a circuit which recognizes these signals and immediately following entry of the information by the user applies a high speed automatic correction signal to the analogue display whereupon the hour hand is rapidly corrected the desired amount.

SUMMARY OF THE INVENTION

The invention accordingly provides an hour hand corrector for a timepiece having a first analogue type display employing time-indicating hands to display hours and minutes and a second digital type display employing numbers to display further information, both displays being electronically controlled, the analogue display being normally advanced in accordance with elapsed time, and including user accessible switch means adapted to enter information into the digital display representative of the nature and amount of hour hand correction required, means adapted to generate a correction signal after all information has been entered, a switch and a modulo N counter both responsive to said correction signal to direct higher than normal frequency signals to said analogue display, the number of said higher frequency signals being an integral multiple of N.

BRIEF DESCRIPTION OF THE DRAWINGS

The single FIGURE shows one form of logic circuit which may be employed to achieve the ends of the invention.

DETAILED DESCRIPTION OF THE INVENTION

It is assumed that the stepping motor used for driving the analogue display employed in this invention is capable of stepping in one sense only. Whenever hour hand corrections are carried out it is evidently desirable to limit these as much as possible, this in order to conserve battery current. In changing time zones it is theoretically possible to subtract or to add 23 hours. However, in most timepieces the hour hand reads from 0 to 12. The stepping motor drives the minute hand directly whereby for each rotation of the minute hand the hour hand is stepped through one hour. The present invention ensures that no matter what correction is required, the hour hand will step through a maximum of 11 hours.

Four different cases are apparent. Assume that the user is travelling east and wishes to add 7 hours to his timepiece display conforming to the number of time zones crossed. Select switch 1 will be operated to generate an add signal which is stored in element 3. The add signal is applied to AND-gates 7 and 28 for reasons which will become apparent during the subsequent description. Next the user applies a series of 7 correction signals via the switch 2, and AND-gate 4 enabled by the $\overline{Q}$-signal from flip-flop 18 transmits these correction signals through OR-gate 5 and into counter 8 where they are registered. The signals will appear on output lines $Q_1$, $Q_2$ and $Q_3$ associated with counter 8 and will be transmitted to decoder 10 and display 11.

Operating the corrector switch 2 also transmits a reset signal to flip-flop 27 and through OR-gate 26 to reset timing circuit 17. As soon as the information has been completed no further reset signals will appear on timer 17 whereupon a 1 Hz input signal may be passed through with a predetermined delay. Following such delay the correction will be automatically started and continued and at the same time flip-flop 27 is set to assure that no further signals pass through delay circuit 17.

The correction start signal is applied to set a flip-flop 18 and to enable a latch 12 via line 34. The Q-signal now available from flip-flop 18 provides a "1" enable signal to AND-gate 24 and "1" enable signal to AND-gate 15.

Enabling latch 12 permits the digits representing 7 in decoder 10 to be transmitted to comparator 13. At this time, counter 14 will be cleared and there will be no equality. The output from comparator 13 is in the form of a signal which when equality is achieved will be "0", but at other times will be "1". Since at this moment there is no equality a "1" is applied as an enabling signal to AND-gate 15 and as disabling signal to NOR-gate 22. Accordingly, a 32 Hz signal from other timepiece circuits (not shown since not forming part of the present invention) is transmitted by gate 15 and applied to counter 14 and to AND-gates 28 and 29. It will be apparent that as soon as the contents of counter 14 arrive at the number 7 as initially stored in the counter 8 a disable signal in the form of a "0" will be applied from comparator 13 to AND-gate 15.

Associated with output lines $Q_3$ and $Q_4$ from counter 8 is a detecting gate 19 which will indicate when the state of counter 8 is at twelve. Since at the present time, according to the example chosen, counter 8 is showing 7 as its contents there will be a zero output from AND-gate 19 and since at the same time the counter is storing more than "0" an output line from decoder 10 intended to show when this is decoding "0" will have a zero output. These two "0" outputs are applied to NOR-gate 21 which accordingly produces a "1" output to provide a further enable to AND-gate 24 and disable to NOR-gate 22. AND-gate 24 is now fully enabled and thus 32 Hz signals from the main timekeeping circuit may be transmitted thereby to advance the stepping motor not shown, via line 34. At the same time said 32 Hz signals are applied to counter 16 which may be a modulo sixty counter. Each time counter 16 arrives at a total of sixty it will produce an output signal which signal will be transmitted through enabled gate 7 to step counter 8 down one step.

Higher frequency pulses will continue to be transmitted via AND-gate 24 to the stepping motor and to the counter 16 until the counter 8 has been stepped down to zero. At this time decoder 10 will register a state of "0" and a "1" signal will be applied to NOR-gate 21 thereby changing its output to "0" thus applying an enable signal to NOR-gate 22 whilst disabling AND-gate 24.

Since NOR-gate 22 was already receiving a "0" signal from comparator 13 it will be seen that a "1" signal will be transmitted to set flip-flop 23. The Q-output from flip-flop 23 is applied to OR-gate 25 to reset counter 8 and to reset inputs of counter 14 and flip-flop 18. Resetting flip-flop 18 removes the Q enabling signal from AND-gate 24, but provides a $\overline{Q}$ enabling signal to gate 4 to which correction signals may subsequently be applied.

Consider next a correction operation in which the correction to be applied is 7 hours, but the traveller in question is proceeding from east to west therefore, he will wish to subtract 7 hours from his timepiece hour hand display. In this case, the selecting switch 1 will be switched to show that a negative correction is to be applied and 7 hours are to be subtracted from the hour hand display. It will be readily realized that the subtraction of 7 hours is the same as the addition of 5 hours where we are concerned with a modulo 12 display such as is the case with standard analogue timepiece displays. The operation of the circuits will be virtually be the same as in the case where 7 hours was to be added. In this case, however, AND-gate 6 will be enabled rather than AND-gate 7. Accordingly, when AND-gate 24 is enabled to transmit 32 Hz to the stepping motor and to the counter 16 output signals from counter 16 will be applied to add to counter 8. As soon as counter 8 reaches a count of 12 however, AND-gate 19 will be enabled and will provide a disabling signal to NOR-gate 21 thereby to terminate operation as in the preceeding example.

Suppose now the correction is to be one of plus 15 hours. Except for the possible influence such may have on the operation of the date display this is the same as the correction of plus 3 hours. As soon as the capacity of counter 8 has been exceeded by application of correction signals thereto, a carry-over will be produced and will set stage 9. The output from stage 9 and the output from AND-gate 19 will be combined in AND-gate 20 and applied through OR-gate 25 as a reset signal to counter 8 and stage 9. Prior to said resetting, however, such counts will have been transmitted to latch 12 via decoder 10. When all information has been entered counter 8 will store 3 whereas counter 14 will store 15. In all other respects the operation of correction is the same as when the count of 7 was added in the first mentioned example.

Suppose finally that 15 hours is to be subtracted from the display. This is the same as addition of 9 hours to the display. In this case the operation will be the same as where 15 hours were to be added insofar as the operation of counters 8, 14 and stage 9 as well as AND-gates 19 and 20 is concerned. As in the case where 7 hours were to be subtracted, previously described herein, AND-gate 6 is enabled whereby counter 16 adds 1 to counter 8 for each complete revolution of the minutes hand. As in the previous example, as soon as counter 8 reached a count of 12, the operation will be terminated.

Further shown in the drawing are AND-gates 28, 29, OR-gate 30, a date counter 31, decoder 32 and display 33. It will be obvious from what has been previously said that when AND-gate 15 is enabled corrections will be applied via either AND-gate 28 or AND-gate 29 to the date counter 31 the amount of such correction depending upon what has been entered into counter 14. OR-gate 30 provides for normal advance signals to be applied to the date counter.

What we claim is:

1. An hour hand corrector for use with a timepiece of the type having a first analogue type display including time-indicating hands to display hours and minutes and a second digital type display employing numbers to display further information, both displays being electronically controlled and the analogue display being normally advanced in accordance with elapsed time, said hour hand corrector comprising means including user accessible switch means adapted to enter information into the digital display, representative of the nature and amount of hour hand correction required, means adapted to generate a correction signal after all information has been entered, a switch and a modulo N counter both responsive to said correction signal to direct higher than normal frequency signals to said analogue display, N being an integer which is a submultiple of the number of said higher frequency signals required to effect correction of the hour-indicating hand of the analogue display according to the information entered by said user accessible switch means.

2. An hour hand corrector as set forth in claim 1 wherein said means adapted to enter information into the digital display includes a first counter having a capacity equal to the maximum possible hour hand correction, said first counter being responsive to said user accessible switch means for entering the information into the digital display means, said hour hand corrector further comprising a second counter having a capacity equal to the maximum possible hour correction, a comparator responsive to said first and second counters, and detecting means responsive to the comparator output and the first counter contents for disconnecting said switch and modulo N counter when the minimum number of said higher frequency signals necessary to effect the desired correction has been applied to said analogue display.

3. An hour hand corrector as set forth in claim 2 wherein said first counter may count from 0–12 and said second counter may count from 0–23.

4. An hour hand corrector as set forth in claim 3 wherein for positive or negative corrections of less than 12 hours the contents of the first and second counters are equal and for positive or negative corrections of greater than 12 hours the contents of the first and second counters sum to 24.

5. An hour hand corrector as set forth in claim 3 wherein the second counter stores the desired total correction.

6. An hour hand corrector as set forth in claim 2 including a selection switch accessible to the user and adapted to generate a signal indicative of a positive or negative correction and gate means responsive to said signal for decrementing the first counter in the case of a positive correction and increment said first counter in the case of a negative correction.

7. An hour hand corrector as set forth in claim 6 wherein said gate means is coupled to said modulo N counter so as to be enabled each time N higher frequency signals have been directed to the analogue display.

8. An hour hand corrector as set forth in claim 7 wherein said detecting means is adapted to generate a disabling signal to the input of the modulo N counter whenever said first counter stores 0 to 12.

9. An hour hand corrector as set forth in claim 1 including a date counter arranged to receive signals corresponding to the information entered by the user whereby calendar information remains in phase with time of day information.

10. An hour hand corrector as set forth in claim 1 wherein said analogue display comprises an electromechanical display employing a stepping motor capable of rotation in one sense only.

11. An hour hand corrector as set forth in claim 1 wherein N=60.

12. An hour hand corrector as set forth in claim 1 wherein N=30.

* * * * *